United States Patent [19]

Williams

[11] Patent Number: 4,738,879

[45] Date of Patent: Apr. 19, 1988

[54] COATING SYSTEM

[75] Inventor: John K. Williams, Fairport, N.Y.

[73] Assignee: Xerox Corporation, Stamford, Conn.

[21] Appl. No.: 881,541

[22] Filed: Jul. 2, 1986

[51] Int. Cl.[4] ..... B05D 1/28; B05C 1/08

[52] U.S. Cl. ..... 427/428; 118/249; 118/259; 118/261

[58] Field of Search ..... 118/259, 258, 261, 249, 118/661, DIG. 15; 427/428; 101/350, 363

[56] References Cited

U.S. PATENT DOCUMENTS

| | | | |
|---|---|---|---|
| 2,289,798 | 7/1942 | Nadeau et al. | 118/258 |
| 3,045,592 | 7/1962 | Shearer et al. | 101/350 |
| 3,294,060 | 12/1966 | McIntyre et al. | 118/261 |
| 3,492,840 | 2/1970 | Korsch | 68/202 |
| 3,552,292 | 1/1971 | Gold | 95/89 |
| 3,684,561 | 8/1972 | Labombarde | 427/428 |
| 3,722,453 | 3/1973 | Dahlquist et al. | 118/249 |
| 3,963,549 | 2/1976 | Kohler et al. | 427/428 |
| 4,503,802 | 3/1985 | Keller et al. | 118/249 |

FOREIGN PATENT DOCUMENTS

| | | | |
|---|---|---|---|
| 2100955 | 10/1972 | Fed. Rep. of Germany | 427/428 |

*Primary Examiner*—Richard R. Bueker
*Assistant Examiner*—Alain Bashore
*Attorney, Agent, or Firm*—Peter H. Kondo

[57] ABSTRACT

A coating system is disclosed comprising apparatus for coating webs comprising a rigid, elongated trough, a cylindrical applicator mounted for rotation about its axis within the trough, the trough having an arcuate upstream liquid retaining surface and an arcuate downstream liquid retaining surface substantially parallel to and closely spaced from the lower surface of the cylindrical applicator to define an arcuate coating zone, a manifold between the upstream liquid retaining surface and the downstream liquid retaining surface, the manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of any liquid in the coating zone, a wall at each end of the trough to retain the liquid in the coating zone, each of the walls being closely spaced from the adjacent end of the cylindrical applicator, an arcuate drain channel adjacent to at least one of the walls to collect overflow liquid from the downstream liquid retaining zone and return the overflow liquid back by gravity to the manifold, and means for continuously introducing liquid into the manifold. A process for using this type of apparatus for coating webs is also disclosed.

20 Claims, 2 Drawing Sheets

16
10
12
18
20
22
24
26
28
30
32
34
38
39
40
42
46
47
48
50
52
54
56
58
60
62
64
66
68
70
72
74
76
78
82

COATING SYSTEM

BACKGROUND OF THE INVENTION

This invention relates to a coating device and process, and in particular, to a system comprising a trough and a cylindrical applicator for applying fluid to a moving web.

Devices for applying fluids to a moving web are well known. For example, roll coating is one of the common techniques for continuously applying a liquid film onto a moving sheet. Roll coating apparatus often utilize gravure applicators to apply a very thin coating to a moving web. These gravure applicators are generally cylindrical and have an etched surface. These etched surfaces comprise valleys or cells which are filled with an unmetered quantity of the coating material applied from an adjacent roller or by rotating the gravure applicator in a bath of the coating material. A doctoring or wiper blade may be employed to regulate the amount of solution in the cells on the surface of the gravure applicator. As the cylinder rotates, the wiper or doctor blade removes all the excess coating from the surface leaving a measured amount of liquid in the recessed areas or cells. Approximately half of this measured amount of liquid in the recessed areas or cells is then transferred from the cells to a moving web by means of hydrodynamic forces of a fluid having appropriate rheological characteristics such as fluid/solid and fluid/air surface tensions. These rheological characteristics are synchronized with variables such as applicator roll diameter, web surface speed and viscosity of the coating fluid being applied.

PRIOR ART STATEMENT

In U.S. Pat. No. 3,936,549 to Kohler et al a method and apparatus for applying a liquid coating to a strip of material are disclosed. A trough-like pan holds a supply of coating liquid at a constant level maintained by continuous feeding of the coating solution into the pan and draining of the coating solution over weirs spaced inwardly from the ends of a roll partially immersed in the coating liquid. The roll may serve as a backup roll for a strip passing around it or as a transfer roll to transfer coating liquid from the pan to a strip in contact with the upper portion of the roll. The coating system does not appear to relate to the use of gravure roll coating. The coating material is not doctored on the roll and no impression roller is employed to transfer coating material to a web. The weirs are complex adjustable baffles that prevent coating material from contacting the ends of the roll. The coating material that overflows the weirs is drained out of the pan prior to recycling.

In U.S. Pat. No. 4,503,802 to Keller et al, a device is disclosed for applying fluid to moving webs in which a rotating lower roller has a bottom portion immersed in a pool of fluid contained in an open pan. The lower roller is used to transfer fluid from the trough to a second roller engaged with the first roller. The open pan employed with the 3-roller applicator is of an unspecified design. The applicator is apparently intended to apply thin or light fluid coatings to a moving fabric web. The applicator roll contains very large grooves or recesses and no post doctoring of the coating fluid is utilized to transfer solution to a moving web.

In U.S. Pat. No. 3,552,292 to Gold, a photographic processing apparatus is disclosed which employs a roll that rotates in a well in which liquid is maintained at a constant volume. Fluid absorbed by the roll as it rotates through the liquid is passed to the surface of an oppositely moving sheet material. Thus, this patent relates to a kiss coating system utilizing a non-adjustable roll with a liquid container. The coating weight thickness applied is very dependent on viscosity, roll speed and web speed. The coater system of the Gold patent is entirely enclosed and cannot be observed by the operator to determine whether the coating solution is uniformly wetting the entire roll surface.

In U.S. Pat. No. 3,492,840 to Korsch, a dyeing apparatus is disclosed in which a roller is positioned in a pan equipped with feeding and discharge means to control the level of fluid therein. When the roller is rotated through the pan, the fluid adheres to the roller and is subsequently transferred to a textile surface which contacts the roller. The closed pan employed by Korsch can be rotated to adjust the amount of solution needed for transfer by the first roll to the nip or nap side of a fabric. There is no post metering of the solution as in a gravure process. Only the amount of solution on the roller after emerging from the pan dictates the wet film thickness of the coated substrate after it leaves the applicator roll. Moreover, this process employs an overflow weir and pump for complete solution (dye) recirculation.

These coating systems provide satisfactory results for many applications. However, when open pans or troughs of coating fluid are employed to apply the coating liquid to the surface of applicator rollers, difficulties have been experienced where the viscosity and solids concentration in the coating solution must be regulated within very narrow limits to achieve precise coatings for applications such as layers in electrostatographic imaging members. The problem is particularly acute when the coating solution is applied to the cylindrical applicator by merely dipping a portion of the cylinder in a bath of the coating solution contained in the open pan or trough. The open pan or trough technique lends itself to environmental contamination of the coating material by elements in the ambient atmosphere such as lint and dirt particles. This in turns leads to undesirable variation in the dry coating thickness on the web and surface defects in the deposited coating that adversely affect coated article yields. Open troughs also promote excessive evaporation of coating solvents or carriers which can dramatically alter the concentration of coating solids and the viscosity of the coating material. Most open troughs must frequently be emptied, cleaned and filled with fresh material by hand which is time consuming, expensive and normally requires shut down of the entire coating line.

Some troughs require the use of a large volume of coating material which necessitates larger investment in material and greater waste when the material is replaced by fresh coating material after the troughs are cleaned. Further, many troughs do not recirculate the coating material that may overflow from the trough or require costly recirculating pumps and hoses which involve use of even larger quantities of coating material and are most costly to initially install, maintain, clean and repair.

Many coating systems also have limited capability for adjustments and cannot readily accommodate variations in the coating parameters such as coating material viscosity, applicator roll speed and the like. Cylindrical applicators employed for webs often exhibit various other disadvantages such as an absence of means to adjust the coating fluid trough up or down relative to a cylindrical applicator immersed in the coating material in the trough.

Generally, troughs are made out of heavy and expensive metallic materials which can often damage applicator rolls if brought into contact with the delicate outer surface of the applicator rolls. Troughs that are machined out of blocks of metal are both expensive and extremely difficult to handle because of their weight. For example, it is estimated that the trough illustrated in FIG. 1 of U.S. Pat. 3,552,292 weighs as much as 300 to 400 pounds for systems capable of coating a web having a width of about 44 centimeters.

Other coating systems are nessarily complex and require the use of elaborate apparatus such as three roll devices, e.g. reverse roll gravure systems.

Thus, while systems utilizing the above-described known approaches may be suitable for their intended purposes, there continues to be a need for the development of an improved coating system.

OBJECTS OF THE INVENTION

It is an object of this invention to provide a novel coating system which overcomes the above-noted disadvantages.

It is another object of this invention to provide a coating system for precisely maintaining viscosity and solids concentration in coating solutions.

It is still another object of this invention to provide a coating system for reducing environmental contamination of the coating material.

It is another object of this invention to provide a coating system for minimizing excessive evaporation of coating solvents or carriers.

It is still another object of this invention to provide a coating system for reducing the frequency of emptying, cleaning and filling of coating troughs.

It is another object of this invention to provide a coating system for minimizing the amount of coating material employed in coating troughs.

It is still another object of this invention to provide an adjustable coating system which accommodates variations in the coating parameters.

It is another object of this invention to provide a coating system utilizing lighter weight and less expensive coating troughs.

It is still another object of this invention to provide a simpler coating system.

It is another object of this invention to provide a coating system for reducing or eliminating damage, particularly to the applicator cylinder, when coating system components contact each other.

SUMMARY OF THE INVENTION

The foregoing objects and others are accomplished in accordance with this invention by providing an apparatus and process for coating webs in which the apparatus comprises an elongated trough, a cylindrical applicator mounted for rotation about its axis within the trough, the trough having an arcuate upstream liquid retaining surface and an arcuate downstream liquid retaining surface substantially parallel to and closely spaced from the lower surface of the cylindrical applicator to define an arcuate coating zone, a manifold between the upstream liquid retaining surface and the downstream liquid retaining surface, the manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of any liquid in the coating zone, a wall at each end of the trough to retain the liquid in the coating zone, each of the walls being closely spaced from the adjacent end of the cylindrical applicator, an arcuate drain channel adjacent to at least one of the walls to collect overflow liquid from the downstream liquid retaining zone and return the overflow liquid back by gravity to the manifold, and means for continuously introducing liquid into the manifold.

The process for applying a coating to a moving web according to this invention comprises providing an elongated trough, rotating a cylindrical applicator about its axis in contact with coating liquid within the trough, the cylindrical applicator being below and in contact with the web to carry coating liquid from the trough to the web, the trough having an arcuate upstream liquid retaining surface and an arcuate downstream liquid retaining surface substantially parallel to and closely spaced from the lower surface of the cylindrical applicator to define an arcuate coating zone, the arcuate upstream liquid retaining surface and the arcuate downstream liquid retaining surface being separated by a manifold extending substantially parallel to the axis of the cylindrical applicator, the arcuate downstream liquid retaining surface and the arcuate upstream liquid retaining surface extending from the manifold upwardly a sufficient distance along the periphery of the cylindrical applicator to retain most of the liquid in the coating zone, continuously supplying sufficient coating liquid to the arcuate coating zone whereby the coating liquid coats the entire length of the lower surface of the cylindrical applicator and overflows the downstream end of the arcuate downstream liquid retaining surface, collecting the coating liquid overflowing the downstream end of the arcuate downstream liquid retaining surface, conveying by gravity to the manifold the coating liquid overflowing the downstream end of the arcuate downstream liquid retaining surface in an arcuate path adjacent to at least one end of the cylindrical applicator.

BRIEF DESCRIPTION OF THE DRAWING

Other aspects of the present invention will become apparent in view of the following description with reference to accompanying drawings.

DETAILED DESCRIPTION

Figure 1:
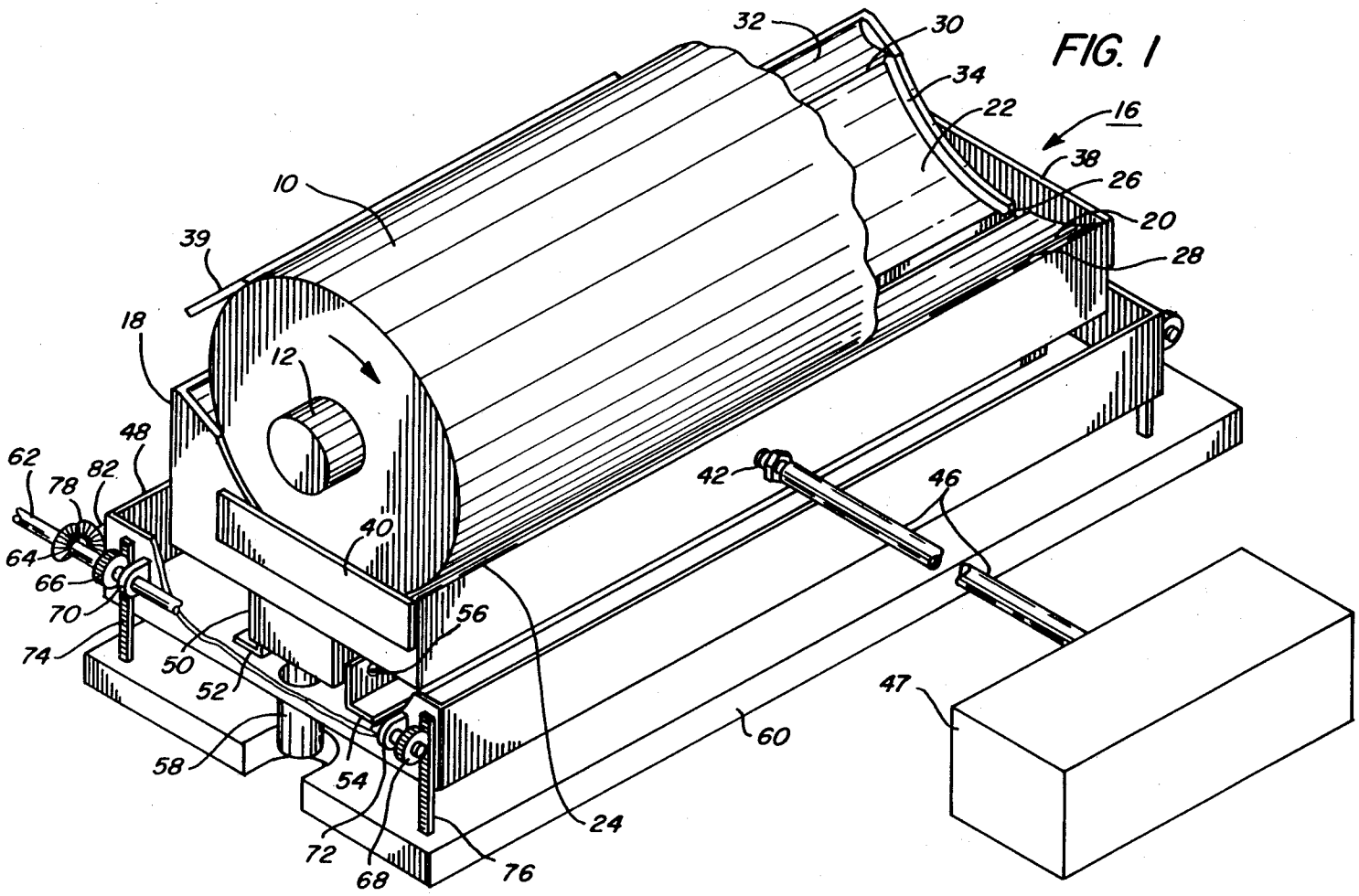
FIG. 1 shows a schematic elevational view depicting a coating device incorporating one embodiment of the present invention.

Inasmuch as the art of coating with cylindrical applicators is well known, the various processing stations employed in the coating system illustrated in the drawings will be described only briefly.

Referring to FIG. 1, a coating system is illustrated comprising cylindrical applicator 10 supported on a shaft 12, the ends of shaft 12 being supported in suitable bearings mounted in a suitable frame or stand and driven by a conventional drive motor (not shown). The lower section of cylindrical applicator 10 is immersed in a liquid coating material (not shown) contained in elongated trough 16 which is supported independently of cylindrical applicator 10. Elongated trough 16 comprises a molded plastic member 18 having arcuate upper surfaces comprising an arcuate upstream liquid retaining surface 20 and an arcuate downstream liquid retaining surface 22. The upstream liquid retaining surface 20 and the downstream liquid retaining surface 22 are substantially parallel to and spaced from the lower arcuate surface of cylindrical applicator 10 to define a coating zone 24. A manifold 26 between the upstream liquid retaining surface 20 and the downstream liquid retaining surface 22 extends along the length of cylindrical applicator 10. Manifold 26 is substantially parallel to shaft 12. The upstream lip 28 of upstream liquid retaining surface 20 and the downstream lip 30 of downstream liquid retaining surface 22 extend a sufficient distance upwardly from manifold 26 to retain most of any liquid in coating zone 24. Because of the pumping action resulting from rotation of cylindrical applicator 10 in a closely spaced relationship to the parallel liquid retaining surfaces 20 and 22, downstream lip 30 must be higher than upstream lip 28 but not so high as to prevent a limited amount of overflow of coating material. An overflow recirculating trough 32 is positioned adjacent the downstream lip 30 of downstream liquid retaining surface 22 to collect coating materials overflowing downstream lip 30. Downstream liquid retaining surface 22 also contains at least one arcuate drain channel or groove 34 which extends from overflow recirculating trough 32 to manifold 26. Preferably, another parallel drain channel (not shown) extending from recirculating trough 32 to manifold 26 is positioned adjacent the opposite end of cylindrical applicator 10 and adjacent to end wall 40. As cylindrical applicator 10 is rotated in the direction of the arrow, the layer of coating material carried on the surface of cylindrical applicator 10 as it emerges from coating zone 24 is doctored by doctor knife 39. End wall 38 and end wall 40 are provided at each end of elongated trough 16 adjacent the ends of cylindrical applicator 10 to confine the liquid coating mixture in elongated trough 16. An inlet fitting 42 is connected by hose 46 to a suitable conventional pump and metering means 47 to continuously feed coating material to manifold 26. Coating material supplied through fitting 42 and from arcuate drain channel 34 is uniformly distributed along the entire lower surface of cylindrical applicator 10 by manifold 26. An overflow pan 48 is positioned below molded plastic member 18 to catch any overflow of coating liquid from molded plastic member 18. Molded plastic member 18 is supported on a spacing block 50 which is secured to bracket 52 and bracket 54 by means of bolts 56 (only one being shown). A drain tube 58 is provided at at least one end of overflow pan 48 to allow any overflowing liquid from molded plastic member 18 to drain out of overflow pan 48 into a suitable collecting container or or other suitable disposal system (not shown). Vertical adjustment of the overflow pan 48 relative to platform 60 is achieved by rotation of shaft 62 on which is mounted pinion gear 64, gear 66 and gear 68. Shaft 62 is supported by flange 70 and flange 72. The teeth of gear 66 and gear 68 are adapted to mesh with the teeth of flat gear 74 and flat gear 76, respectively. Pinion gear 64 is adapted to mesh with the teeth pinion gear 78. Pinion gear 78 is mounted on one end of shaft 82. A pinion gear (not shown) similar to pinion gear 78 is mounted on the opposite end of shaft 82 to mesh with the teeth of another pinion gear (not shown) which drives a gear assembly which cooperate with gears 64, 66, 74 and 76 to raise and lower overflow pan 48. Since elongated trough 16 is supported by spacing block 50 which in turn is supported by overflow pan 48 via brackets 52 and 54, vertical adjustment of the pan 48 also vertically adjusts trough 16. Also, since cylindrical applicator 10 is supported on a frame or stand (not shown) independently of trough 16, vertical adjustment of trough 16 adjusts the vertical distance between trough 16 and cylindrical applicator 10. If desired, other suitable means such as scissor jacks, pneumatic cylinders with stops, and the like.

Figure 2:
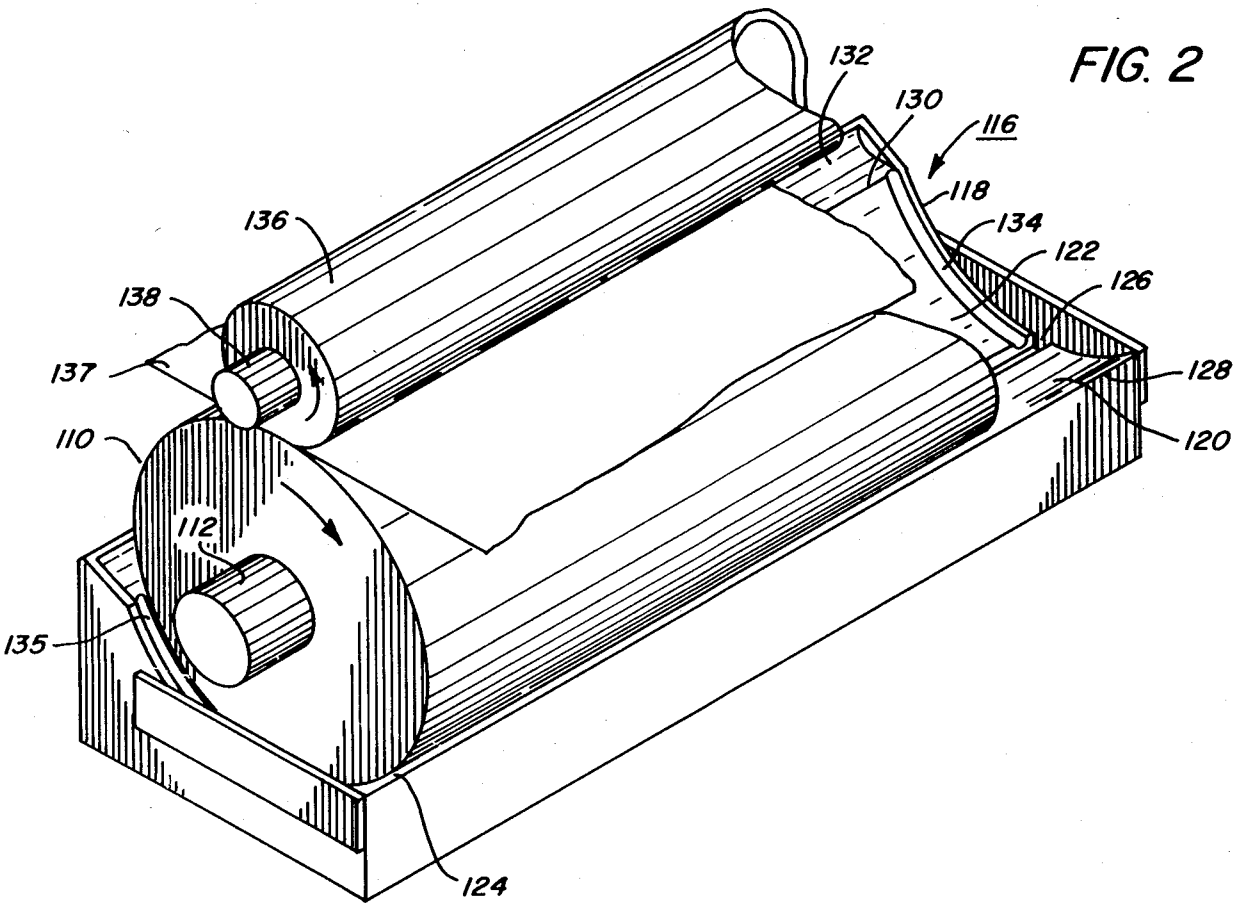
FIG. 2 shows a schematic elevational view depicting a coating device incorporating another embodiment of the present invention.

Referring to FIG. 2, another embodiment of the coating system of this invention is illustrated comprising cylindrical applicator 110 supported on a shaft 112, the ends of shaft 112 being supported in suitable bearings mounted in a frame or stand (not shown). Cylindrical applicator 110 is immersed in a liquid coating material (not shown) contained in elongated trough 116 which is supported independently of applicator 110. Elongated trough 116 comprises a molded plastic member 118 having arcuate upper surfaces comprising an arcuate upstream liquid retaining surface 120 and an arcuate downstream liquid retaining surface 122. The upstream liquid retaining surface 120 and the downstream liquid retaining surface 122 are substantially parallel to and spaced from the lower arcuate surface of cylindrical applicator 110 to define an arcuate coating zone 124. A manifold 126 between the upstream liquid retaining surface 120 and the downstream liquid retaining surface 122 extends along the length of cylindrical applicator 110. Manifold 126 is substantially parallel to shaft 112. The upstream lip 128 of upstream liquid retaining surface 120 and the downstream lip 130 of downstream liquid retaining surface 122 extend a sufficient distance upwardly from manifold 126 to retain most of any liquid in coating zone 124. Because of the pumping action resulting from rotation of cylindrical applicator 110 in a closely spaced relationship to the parallel liquid retaining surfaces 120 and 122, downstream lip 130 must be higher than upstream lip 128 but no so high as to prevent a limited amount of overflow of coating material. An overflow recirculating trough 132 is positioned adjacent the downstream lip 130 of downstream liquid retaining surface 122 to collect coating materials overflowing downstream lip 130. Downstream liquid retaining surface 122 also contains at least one arcuate drain channel 134 which extends from recirculating trough 132 to manifold 126. Preferably, another substantially parallel drain channel 135 extending from overflow collect trough 132 to manifold 126 is positioned adjacent the opposite end of applicator 110. Drain channel 134 in the embodiment illustrated in FIG. 2 differs from that of FIG. 1 in that drain channels 134 and 135 are located beyond the ends of the cylindrical applicator roll 110. Moreover, channels 134 and 135 may be narrower and shallower than drain channel 34 because compensation against the pumping action of the rotating cylindrical applicator 110 is unnecessary for the uninhibited gravity draining of coating material down drain channel 134 to manifold 126. An impression roll 136 is positioned at about the 12 o'clock position of cylindrical applicator 110 to assist in transfer of the coating material from cylindrical applicator 110 to web 137. Impression roll 136 is supported on a shaft 138, the ends of shaft 12 being supported in suitable bearings mounted in a frame or stand (not shown).

Any suitable rigid, metallic or non-metallic material may be utilized to form the trough of this invention.

Typical metallic materials include stainless steel, aluminum, chrome plated steel, nickel plated steel and the like. Typical non-metallic materials include resins such as polyethylene, polypropylene, polytetrafluoroethylene, nylon, polyurethane, and the like. If desired, combinations of metal and non-metallic materials may be utilized such as a metal trough coated with a non-metallic coating or a plastic trough coated with a metallic coating. A particularly preferred material is ultrahigh molecular weight polyethylene having a number average molecular weight between about $3.1\times10^6$ and about $5.6\times10^6$. These materials are very hard, readily machinable, and characterized by sufficient rigidity to maintain tolerances without reinforcing materials. The trough materials should not react with or dissolve in any of the components of the coating mixture such as the solvent or liquid carrier utilized. Preferably, the surface of the trough material facing the applicator roller is constructed of a material having a Rockwell "R" hardness less than than that of the applicator roll such as about 64 to prevent damage to the applicator roller surface should the trough accidentally come in contact with the applicator roll during installation or adjustment. The trough may be made by any suitable technique such as machining, stamping, welding, molding, and the like. Thus, for example, metal troughs constructed from sheet metal can be formed by stamping and/or welding.

The drain channels may have any suitable cross section. Typical cross sectional shapes include semicircular, V-shaped, U-shaped, square, rectangular, and the like. The total cross sectional area of the drain channels should be sufficient to compensate against the pumping action of the rotating cylindrical applicator roll thereby allowing coating material to flow back by gravity to the manifold from the recirculating trough for recycling and to prevent significant overflow of the coating material out of the recirculating trough into the overflow pan. The arcuate upstream liquid retaining surface and arcuate downstream liquid retaining surface of the elongated trough are substantially parallel to the adjacent lower surface of the cylindrical applicator for optimum coating uniformity, strong recirculating pumping action due to the closely spaced surfaces, and reduced volume of liquid in the elongated trough. For drain channels having a semicircular cross section, the channels may have, for example, a width of from about 5 to 30 mm, preferably from about 10 to 12 mm, and a depth of from about 2 to 4 times the trough-to-cylindrical applicator spacing.

The manifold may have any suitable cross section. Typical cross sectional shapes include semicircular, V-shaped, U-shaped, square, rectangular, inverted keyway and the like. The total cross sectional area of the manifold should be sufficient to provide a sufficient supply of coating material along the entire length of the cylindrical applicator to fill the coating zone between the downstream liquid retaining surface and the adjacent lower surface of the cylindrical applicator during rotation of the cylindrical applicator and to ensure that the coating material overflows the downstream lip of the downstream liquid retaining surface and flows back by gravity to the manifold from the recirculating trough for recycling. For manifolds having a square cross section, the manifold may have, for example, a width of from about 1 to 5 cm, preferably from about 1.5 cm to about 2.5 cm, and a depth of from about 4 to about 6 times the trough-to-cylindrical applicator spacing.

As indicated hereinbefore, the arcuate upstream liquid retaining surface and arcuate downstream liquid retaining surface of the elongated trough are substantially parallel to and closely spaced from the adjacent lower surface of the cylindrical applicator to provide a strong recirculating pumping action during rotation of the cylindrical applicator. The surface areas of the arcuate upstream liquid retaining surface and arcuate downstream liquid retaining surface should be sufficient to hold enough coating material to coat the entire length of the lower surface of the cylindrical applicator and to achieve overflow of the coating material over the downstream lip of the downstream liquid retaining surface and flow back by gravity to the manifold from the recirculating trough for recycling. Generally, the size of the surface area of the arcuate downstream surface is approximately twice that of the arcuate upstream surface.

Any suitable cylindrical applicator may be utilized in the coating system of this invention. The cylindrical applicators preferably have a metallic outer surface for greater resistance to wear during extended coating operations. To minimize excess of wear of the coating cylindrical applicator, a chrome or other suitable hard metal layer may be applied over a base such as copper flashed steel. The cylindrical applicator may have a smooth surface or a patterned surface. For the application of low viscosity fluids, a patterned applicator is preferred for greater thickness control and wet film smoothness. For the purposes of the description of this invention, low viscosity fluids have a viscosity of less than about 1000 centipoises. Higher viscosity fluids may be different to employ with gravure applicators due to drying of the coating materials in the gravure applicator cells during the coating operation. The rate at which a coating solution is consumed depends to some extent on the cell pattern employed on the surface of the coating applicator. This is generally described in terms of the number of cells per square inch and the width of the etched portion of the cylindrical applicator. Typical cell patterns include pyramid and quadrangular cells. The cell walls are not perpendicular but are tapered to improve coating release. The type and size of the cell pattern partly determines the appearance of the coated surface and thickness. The proportion of cell width to wall thickness is for example about 2½:1 with typical cellular opening percentages ranging from about 20 percent to about 45 percent of the etched volume. Low viscosity solutions which are applied to form a dry film by gravure technique normally employ cell pattern sizes of between about 200 to about 400 lines per inch (about 4,000 to about 160,000 cells per square inch). Additionally, the cell depths generally range from about 0.0007 inch to about 0.002 inch depending upon the cell shape and size. Any suitable gravure pattern may be utilized. Typical gravure patterns include pyramid, quadrangular, trihelical, hexagonal, QCH-quad channel (available from Consolidated Engravers, Inc., Dallas, Texas and North Carolina) and the like. Satisfactory results may be achieved when gravure applicator has a pattern having a volume range between about 1 cubic billion microns per inch squared and about 10 cubic billion microns per inch quared when employed with liquid coating mixtures having a viscosity between about 1 CPS and about 50 CPS and a surface speed of between about 5 feet per minute and about 200 feet per minute. However, speeds above and below this range may also be suitable. The close spatial relationship between the cylindrical applicator and adjacent trough surfaces produces a shearing action which when coupled with the recycling of the coating material by the drain channels helps maintain in suspension any particles dispersed in the coating materials However, some coating solutions or dispersions tend to settle during a long coating run if the applicator cylinder speed is not sufficient to provide adequate agitation to maintain the dispersion. If the applicator cylinder speed is not adequate to maintain the dispersion, additional solution or dispersion recirculation equipment may be employed to maintain homogeneity of the coating mixture. Excellent results have been achieved with a gravure applicator having a radius of about 5 inches, a QCH-quad channel pattern (400, available from Consolidated Engravers, Inc.,) having a cell volume of about 2.8 cubic billion microns per inch squared, and a gravure applicator surface speed about 150 feet per minute. The dimensions of the cylindrical applicator do not appear to be critical. Typical cylindrical applicator radii range from about 4 inches to about 8 inches. However, radii above and below this range may also be satisfactory. For example, excellent results have been achieved with a gravure cylinder applicator roll having a diameter of about 10 inches and a 360 QCH-Quad channel. The lines per inch (LPI) was about 360 QCH, the depth was about 0.0012 inch and the volume per square inch was about $5.8 \times 10^9$ cubic billion microns.

Any suitable means may be utilized to doctor the liquid coating mixture on the surface of the patterned applicator. Typical doctoring means include thin flexible metallic or non-metallic blades positioned in a trailing mode or in a reverse angle (doctoring) mode as well as other devices such as air knives. Generally, the blades or knives may be utilized in either the scrapping or wiping attitude. Typical metallic blades include stainless steel, high carbon steel, and the like. An example of a steel blade is one made of Swedish blue steel or AiSl 1095 hardenable sheet steel having a carbon content of about 1 percent. Typical non-metallic blade materials include polyurethane, neoprene, nylon, and the like. Composite blades of layers of metallic and non-metallic materials may also be utilized if desired.

The doctor blade is usually located between about the 10 o'clock and 10:30 o'clock position for optimum thickness control while avoiding premature drying through the evaporation of liquids from the coating mixture. Doctor blades positioned in the wiping attitude are preferred to minimize evaporation of the coating after doctoring but prior to contact with the web surface to be coated. A typical doctor blade angle for gravure applicators involve a contact angle of between about 55° and abut 65° through an imaginary plane tangent to the cylindrical applicator. Due to the attitude of the wiping blade, it can be positioned closer to the impression roll to minimize the area of the doctored surface exposed to evaporation prior to transfer of the coating material to the web surface. Since about 50 percent of the doctored film on the applicator roller is transferred to the web during transfer, the amount of evaporation of the coating components between the doctoring and transfer steps can significantly affect the thickness of the final coating on the web. The distance between the doctor blade and the impression roll nip with the specific cylindrical applicator is also selected to ensure that the solution during transfer is at a viscosity suitable for sufficient transfer of the coating material from the cylindrical applicator to the web.

After the surface of the cylindrical applicator is rotated out of the coating mixture in the trough, all the cells are filled and the excess solution is removed from the unetched areas of the cylindrical applicator by the doctor blade applied under pressure at a preselected angle to the applicator. If desired, the doctor blade may be oscillated by conventional means in a direction, for example, parallel to the axis of the cylindrical applicator. The pressure of the blade is dependent upon the viscosity and speed of the roll. For example, a coating system operating at about 1,000 feet per minute line speed and employing a coating mixture having a viscosity of about 30 to about 60 centipoises will utilize a blade pressure of about 40 pounds per linear inch of the cylindrical applicator. Lower viscosities utilize a lower pressure down to about 0.5 pounds per linear inch of the cylindrical applicator to minimize wear of the applicator caused by the reduced quantity of coating material which in turn reduces the lubrication of the applicator. Damaged applicators and/or doctor blades produce streaks on the finished product which is undesirable for precision products. The open design of the coater system of this invention is readily allows visual observation by the operator of the surface of the cylindrical applicator prior to and after engagement with the doctor blade to determine whether the coating material is uniformly wetting the entire cylindrical applicator surface.

Contact pressure between the gravure applicator and the web to be coated is exerted by an impression roll. The transfer of solution from the cells on the cylindrical applicator to the web is by capillary attraction and impression pressure. The outer surface of the impression roll is general constructed of a compressible material which is inert to the solvents or vehicle used in the coating solution. Typical impression roll materials include elastomeric materials such as rubber, polyurethanes, and the like. For non-absorbent substrates, the hardness of the impression roll covering is between about 50 and about 65 shore "A". For non-absorbent substrates, the impression roll pressure exerted on the web and gravure roll is between about 20 pounds per linear inch and about 100 pounds per linear inch. Generally, the impression roll pressure coupled with the durometer hardness of the impression roll material are selected to cause less than about 0.050 inch penetration into the web material to avoid excessive stress from the impression roll and to minimize impression roll deterioration. The transfer of solution from the cells on the cylindrical applicator to the web is by capillary attraction and impression pressure. Generally, less than about 75 percent of the coating solution is transferred from the cylindrical applicator to the web. Other factors affecting transfer of the solution include the type of impression roll material and the web speed.

The viscosity of the coating solution is preferably maintained between about 1 centipoises and about 1000 centipoises. In some cases, the viscosity of the coating solution is controlled within a very narrow range. Too high a viscosity solution in the coating trough prevents the solution from filling the cells properly and leads to incomplete coating or coating thickness variations. Solutions which have too low a viscosity also may lead to poor coatings when employing deeper cell patterns. The solution tends to leave the cells too quickly causing striations of light and dark patterns on the substrate referred to as mottling or reticulation. The appropriate viscosity for a given gravure coating system is affected by factors such as the characteristics of the applicator roll surface including shape of any cells, the range of depth of the cells, the speed of the coating line, the solvent evaporation rage, the doctor blade distance to the point of impression and the absorbency of the substrate for the coating solution. A typical range for percent solids in the coating solution is from about 1 percent by weight to about 3 percent by weight based on the total weight of the solution. In a typical process of this invention, the coating solution has a surface tension of about 31.2 dynes per centimeter, a viscosity of about 5 centipoises (0.05 dynes sec/cm$^2$) and a solid content of about 1 percent.

Any suitable web may be coated with the coating system of this invention. Typical web materials include metal, organic polymers, composite materials and the like. Typical organic polymers include polyesters, polycarbonates, polyamides, composite materials and the like. Typical composite materials include coated or laminated webs such as plastic webs coated with a different plastic or coated with vapor deposited metals. Generally, the webs are flexible, thin, and have a substantially uniform thickness.

In a typical process of this invention, a coating system similar to that illustrated in FIG. 1 was employed comprising an ultrahigh molecular weight polyethylene elongated trough having a length of about 50 inches and an arcuate coating material retaining surface width of about 18 inches. The cylindrical applicator was chrome plated; had a length of about 47 inches and a radius of about 5 inches; and the outer surface carried a QCH-quad channel pattern (400, available from Consolidated Engravers, Inc.,) having a cell volume of about 2.8 cubic billion microns per inch squared. Each end of the elongated trough contained parallel drain channels having a semicircular cross section and a radius of about 6 mm. The spacing between the lower surface of the applicator cylinder and the adjacent upstream liquid retaining surface and a downstream liquid retaining surface of the elongated trough was about 4 mm. The coating mixture had a viscosity of about 5 centipoises, a surface tension of about 31.2 dynes per centimeter, and comprised about 1 percent by weight polyester film forming resin dissolved in an organic solvent. This coating mixture was fed into the elongated trough from a pressure pot, by means of a metering pump, conduits and hoses. The coating solution was fed to the trough by means of a closed metering system which continuously supplied fresh coating material to a manifold located along the bottom of the elongated trough through a suitable inlet fitting. The coating material was distributed along the length of the trough via the manifold. As the liquid level in the elongated trough rose, it wetted the lower surface of the cylindrical applicator evenly. The cylindrical applicator was rotated at a surface speed of about 150 feet per minute. As the cylindrical applicator rotated in the trough, the coating mixture entered the cells. After the surface of the cylinder rotated out of the coating mixture in the trough, the excess solution was removed from the unetched areas of the cylindrical applicator by a slowly reciprocating stainless steel doctor blade applied under pressure of about 20 pounds per linear inch of the cylindrical applicator. The doctor blade, in a trailing mode, was located at about the 10:15 o'clock position. The blade contact angle was about 60° through an imaginary plane tangent to the cylindrical applicator. The coating material removed by the doctor blade fell back toward the elongated trough. Rotation of the cylindrical applicator also caused excess coating material on the surface of the cylindrical applicator to overflow the downstream lip of the elongated trough and was collected in a recirculating trough. Excess coating material was applied to the cylindrical applicator to ensure that all the cells on the surface of the applicator roll were filled. The coating material collected in the recirculating trough was recirculated back to the manifold by the drain channels at each end of the elongated trough. The slight amount of coating material that overflowed from the recirculating trough was collected in an overflow pan which contained a drain to a collecting vessel for waste. An impression roll, located at the 12 o'clock position of the cylindrical applicator, applied a pressure of about 50 pounds per linear inch on a polyester web being coated and the cylindrical applicator. The impression roll comprised a steel cylindrical core coated with polyurethane and had an outside diameter of about 10 inches. The deposited thickness of the uniform coating on the web surface after drying was about 0.05 micrometer. The coating system of this invention as described above may be run continuously without any downtime for shutdown for cleaning or changing solutions. Excellent results, for example have been obtained with trial runs of about 6 hours.

The process described above was repeated with a substantially identical cylindrical applicator, doctor blade and impression roll, but with an open pan having a length of about 52 inches, a width of about 18 inches, and a depth of about 10 inches to hold the coating material instead of the elongated trough of this invention. The 4.5 gallons of coating material in the open pan needed to be replaced only after about 2 hours because the material in the pan became "aged" and more viscous thereby changing the appearance of the material and the dry film thickness, Replacement of the coating material in the open pan required shut down of the coating line for about 15 minutes to empty, scrub and refill the pan. This represents significant down time and coating material waste.

The trough of this invention markedly reduces solvent evaporation from the solution prior to application of the solution to the cylindrical applicator and prior to application of the solution to the web. Reduction of solvent evaporation during the coating operation maintains the viscosity and concentration range of the solids in the coating solution within a precise tolerance range. Moreover, the surface area of the coating solution exposed to the ambient atmosphere is greatly reduced thereby reducing environmental contamination such as lint and dirt from entering the solution prior to coating. In addition, the apparatus and process of this invention uses very little solution at any given time to minimize the cost of maintaining a large reservoir of coating solution. Further, this invention extends the period for film coating thereby reducing down time and coating solution waste. The apparatus of this invention is also readily adjustable. It is easily and rapidly cleanable in a continuous cleaning mode involving running solvent through the system without changing any adjustments. The device is particularly efficient compared to other open air trough type devices. Further, the trough of this invention is inexpensive to manufacture, clean, remove and adjust.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. Apparatus for coating webs comprising a rigid, elongated trough, a cylindrical applicator mounted for rotation about its axis within said trough, said trough having an arcuate upstream liquid retaining surface and an arcuate downstream liquid retaining surface substantially parallel to and closely spaced from the lower surface of said cylindrical applicator to define an arcuate applicator coating zone, a manifold between said upstream liquid retaining surface and said downstream liquid retaining surface, said manifold extending substantially parallel to the axis of said cylindrical applicator, said arcuate downstream liquid retaining surface and said arcuate upstream liquid retaining surface extending from said manifold upwardly a sufficient distance along the periphery of said cylindrical applicator to retain most of any liquid in said applicator coating zone, said arcuate downstream liquid retaining surface extending upwardly a greater distance than said arcuate upstream liquid retaining surface to compensate for the pumping action due to rotation of said cylindrical applicator closely spaced from said arcuate downstream liquid retaining surface, an exposed overflow recirculating trough adjacent to the downstream end of said arcuate downstream liquid retaining surface and extending along the length of said elongated trough, said overflow recirculating trough adapted to receive liquid overflowing from said the downstream end of said arcuate coating zone, a wall at each end of said trough to retain said liquid in said applicator coating zone, each of said walls being closely spaced from the adjacent end of said cylindrical applicator, an arcuate drain channel adjacent to at least one of said walls and parallel to one side edge of said arcuate downstream liquid retaining surface to collect overflow liquid from said downstream liquid retaining zone and return said overflow liquid back by gravity to said manifold, and means for continuously introducing liquid into said manifold.

2. Apparatus for coating webs according to claim 1 wherein a second arcuate drain channel is positioned parallel to the side edge of said arcuate downstream liquid retaining surface opposite the other arcuate drain channel.

3. Apparatus for coating webs according to claim 1 wherein said arcuate drain channel extends from said overflow recirculating trough to said manifold, has a semicircular cross section, a width of from about 5 to about 30 mm and a depth of from about 2 to 4 times the trough-to-cylindrical applicator spacing.

4. Apparatus for coating webs according to claim 1 wherein an end of said cylindrical applicator extends completely over said arcuate drain channel.

5. Apparatus for coating webs according to claim 1 wherein the said arcuate drain channel is an exposed channel located beyond an end of said cylindrical applicator.

6. Apparatus for coating webs according to claim 1 including a doctor blade in contact with said cylindrical applicator above and spaced from the downstream end of said arcuate downstream liquid retaining surface.

7. Apparatus for coating webs according to claim 6 wherein said doctor blade in contact with said cylindrical applicator above and spaced from the downstream end of said arcuate downstream liquid retaining surface at between about the 10:00 o'clock and 10:30 o'clock position or at between about the 2:00 o'clock and 2:30 o'clock position.

8. Apparatus for coating webs according to claim 6 wherein said doctor blade is in wiping contact with said cylindrical applicator.

9. Apparatus for coating webs according to claim 6 wherein said the contact angle of said doctor blade with said cylindrical applicator is between about 55° and about 65° through an imaginary plane tangent to said cylindrical applicator.

10. Apparatus for coating webs according to claim 1 including an impression roll adjacent to the upper surface of said cylindrical applicator, the axis of said impression roll being substantially parallel to the axis of said cylindrical applicator.

11. Apparatus for coating webs according to claim 1 including a pan below said trough adapted to collect any overflow of said liquid from said coating zone, said pan having a drain tube for disposal of said overflow.

12. Apparatus for coating webs according to claim 1 wherein said cylindrical applicator is a gravure applicator.

13. Apparatus for coating webs according to claim 10 wherein said cylindrical applicator has a gravure pattern having a volume range between about 1 cubic billion microns per inch squared and about 10 cubic billion microns per inch squared.

14. Apparatus for coating webs according to claim 1 including means to raise and lower said elongated trough.

15. Apparatus for coating webs according to claim 1 wherein said elongated trough has a Rockwell R hardness less than the Rockwell R hardness of said cylindrical applicator.

16. A process for applying a coating to a moving web comprising providing an elongated trough, rotating a cylindrical applicator about its axis in contact with coating liquid having a viscosity of between about 1 centipoise and about 1,000 centipoises within said trough, said cylindrical applicator being below and in contact with said web to carry coating liquid from said trough to said web, said trough having an arcuate upstream liquid retaining surface and an arcuate downstream liquid retaining surface substantially parallel to and closely spaced from the lower surface of said cylindrical applicator to define an arcuate applicator coating zone, said arcuate upstream liquid retaining surface and said arcuate downstream liquid retaining surface being separated by a manifold extending substantially parallel to the axis of said cylindrical applicator, said arcuate downstream liquid retaining surface and said arcuate upstream liquid retaining surface extending from said manifold upwardly a sufficient distance along the periphery of said cylindrical applicator to retain most of said liquid in said coating zone, said arcuate downstream liquid retaining surface extending upwardly a greater distance than said arcuate upstream liquid retaining surface to compensate for the pumping action due to rotation of said cylindrical applicator closely spaced from said arcuate downstream liquid retaining surface, continuously supplying sufficient coating liquid to said arcuate applicator coating zone whereby said coating liquid coats the entire length of the lower surface of said cylindrical applicator and overflows the downstream end of said arcuate downstream liquid retaining surface, collecting coating liquid overflowing said downstream end of said arcuate downstream liquid retaining surface in an exposed overflow recirculating trough adjacent to said downstream end of said arcuate downstream liquid retaining surface and extending along the length of said applicator, conveying by gravity to said manifold said coating liquid overflowing said downstream end of said arcuate downstream liquid retaining surface in a downwardly extending arcuate path adjacent to at least one end of said cylindrical applicator.

17. A process for applying a coating to a moving web according to claim 16 including conveying said coating liquid overflowing said downstream end of said arcuate downstream liquid retaining surface in a drain channel adjacent to at least one end of said cylindrical applicator.

18. A process for applying a coating to a moving web according to claim 16 including conveying said coating liquid overflowing said downstream end of said arcuate downstream liquid retaining surface in exposed drain channels positioned beyond each end of said cylindrical applicator.

19. A process for applying a coating to a moving web according to claim 16 wherein said cylindrical applicator has a gravure pattern having a volume range between about 1 cubic billion micrometers per inch squared and about 10 cubic billion micrometers per inch squared, said coating liquid having a viscosity of less than about 1,000 centipoises, and said elongated trough having a Rockwell R hardness less than the Rockwell R hardness of said cylindrical applicator.

20. A process for applying a coating to a moving web according to claim 16 including doctoring said coating liquid on the surface of said cylindrical applicator after said surface emerges from said trough carrying a thin coating of said coating liquid and prior to contact of said surface with said web and providing contact pressure on said web between said cylindrical applicator and an impression roll to transfer coating liquid from said cylindrical applicator to said web.

* * * * *